US011885332B2

(12) United States Patent
Schnittger et al.

(10) Patent No.: US 11,885,332 B2
(45) Date of Patent: Jan. 30, 2024

(54) OPERATING METHOD FOR A CONVEYING DEVICE WITH AN ECCENTRIC SCREW PUMP FOR CONVEYING VISCOUS CONSTRUCTION MATERIALS

(71) Applicant: J. WAGNER GmbH, Markdorf (DE)

(72) Inventors: Thorsten Schnittger, Frickingen (DE); Lam Huu Nguyen, Woodbury, MN (US)

(73) Assignee: J. Wagner GmbH, Markdorf (DE)

( * ) Notice: Subject to any disclaimer, the term of this patent is extended or adjusted under 35 U.S.C. 154(b) by 0 days.

(21) Appl. No.: 18/043,825

(22) PCT Filed: Aug. 27, 2021

(86) PCT No.: PCT/EP2021/073721
§ 371 (c)(1),
(2) Date: Mar. 2, 2023

(87) PCT Pub. No.: WO2022/048998
PCT Pub. Date: Mar. 10, 2022

(65) Prior Publication Data

US 2023/0235738 A1 Jul. 27, 2023

(30) Foreign Application Priority Data

Sep. 4, 2020 (DE) ..... 10 2020 123 120.2

(51) Int. Cl.
*F04C 28/06* (2006.01)
*F04C 2/16* (2006.01)
*F04C 28/28* (2006.01)

(52) U.S. Cl.
CPC ..... *F04C 28/06* (2013.01); *F04C 2/16* (2013.01); *F04C 28/28* (2013.01); *F04C 2270/19* (2013.01); *F04C 2270/215* (2013.01)

(58) Field of Classification Search
CPC .. F04C 28/06; F04C 2/16; F04C 28/28; F04C 2270/19; F04C 2270/215
See application file for complete search history.

(56) References Cited

U.S. PATENT DOCUMENTS 6,099,264 A * 8/2000 Du ..... F04B 49/03 417/43
7,931,447 B2 * 4/2011 Levin ..... F04B 49/002 700/282

(Continued)

FOREIGN PATENT DOCUMENTS

CN 103486026 A 1/2014
CN 103987967 A 8/2014

(Continued)

OTHER PUBLICATIONS

International Search Report and Written Opinion for International Patent Application No. PCT/EP2021/073721, dated Dec. 14, 2021, 15 pages with English Translation.

(Continued)

*Primary Examiner* — Connor J Tremarche
(74) *Attorney, Agent, or Firm* — Christopher J. Volkmann; Kelly, Holt & Christenson, PLLC

(57) ABSTRACT

An operating method for a conveying device with an eccentric screw pump for conveying viscous construction materials comprising sensing a pressure of the construction material at an outlet of the eccentric screw pump when the eccentric screw pump is running and automatically switching off the eccentric screw pump if the pressure exceeds an upper limit value, otherwise continued operation of the eccentric screw pump. The method includes sensing a characteristic variable of the running eccentric screw pump and comparison of the characteristic variable with a first comparison variable, which is characteristic of operation with an open dispensing device and/or with a second comparison (Continued)

variable, which is characteristic of operation with a closed dispensing device, and switching off the eccentric screw pump if operation with a closed dispensing device is detected, otherwise continued operation of the eccentric screw pump.

18 Claims, 3 Drawing Sheets

(56) References Cited

U.S. PATENT DOCUMENTS

| | | | | |
|---|---|---|---|---|
| 2008/0003114 | A1 | 1/2008 | Levin et al. | |
| 2009/0056324 | A1* | 3/2009 | Itakura | F15B 21/087 91/532 |
| 2012/0087804 | A1* | 4/2012 | Mott | F04B 49/02 417/12 |
| 2012/0133313 | A1* | 5/2012 | Xie | B60W 20/00 318/473 |
| 2012/0271527 | A1* | 10/2012 | Zebrowski | F02C 7/228 60/776 |
| 2019/0283981 | A1* | 9/2019 | Rickers | B65G 33/08 |

FOREIGN PATENT DOCUMENTS

| | | | |
|---|---|---|---|
| CN | 107382011 | A | 11/2017 |
| DE | 19649766 | C1 | 4/1998 |
| EP | 3020974 | A1 | 5/2016 |
| JP | 2002316081 | A | 10/2002 |
| WO | WO2015067582 | A1 | 5/2015 |
| WO | WO2019215242 | A1 | 11/2019 |

OTHER PUBLICATIONS

First Office Action for Chinese Patent Application No. 202180072404.X dated Oct. 12, 2023, 15 pages including English Translation.

* cited by examiner

OPERATING METHOD FOR A CONVEYING DEVICE WITH AN ECCENTRIC SCREW PUMP FOR CONVEYING VISCOUS CONSTRUCTION MATERIALS

CROSS-REFERENCES TO RELATED APPLICATIONS

This Application is a Section 371 National Stage Application of International Application No. PCT/EP2021/073721, filed Aug. 27, 2021, and published as WO 2022/048998A1 on Mar. 10, 2022, and claims priority to German Application No. 10 2020 123 120.2, filed Sep. 4, 2020, the contents of each are hereby incorporated by reference in their entirety.

DETAILED DESCRIPTION

Figure 1:
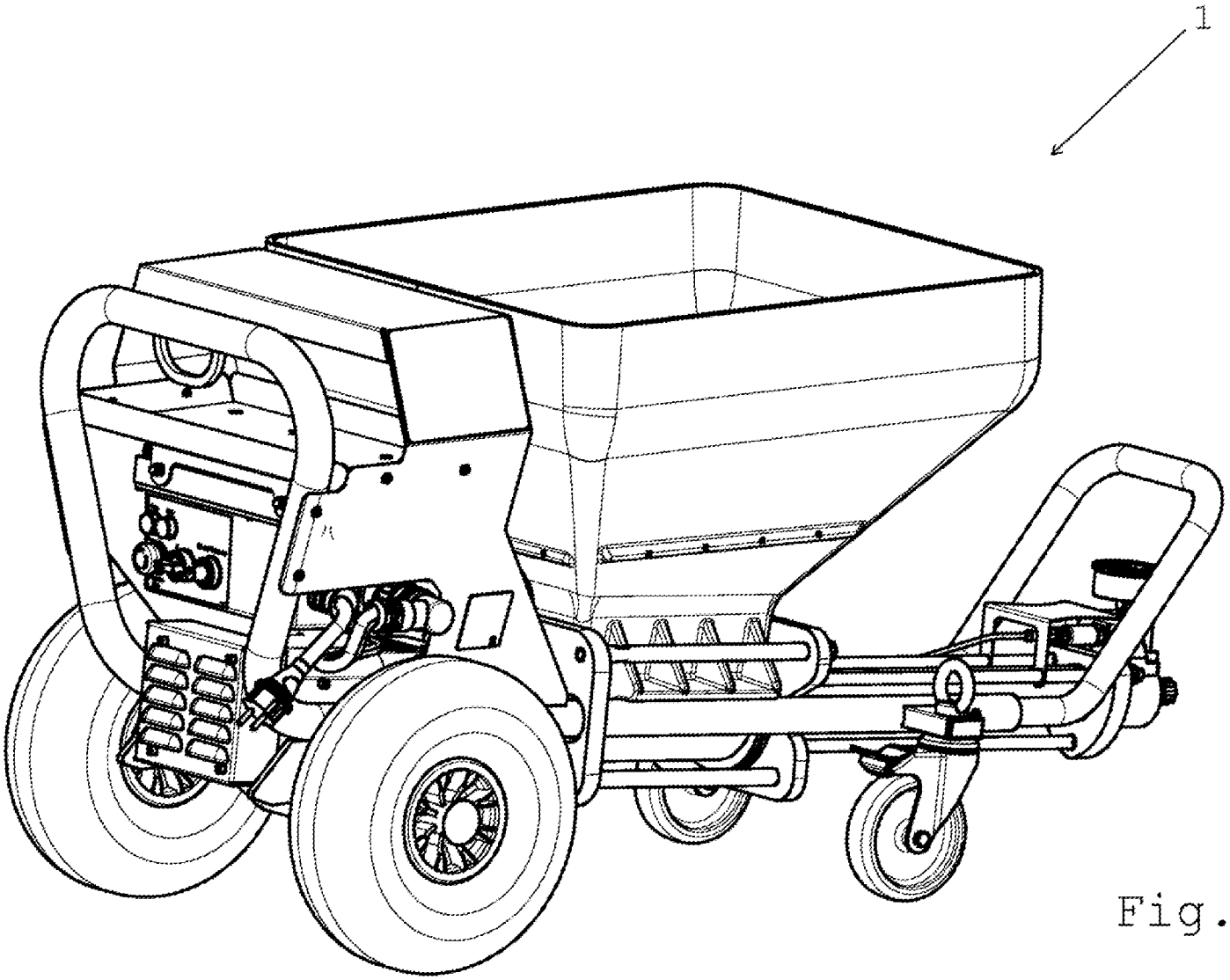
FIG. 1 shows a perspective view of a conveying device, in one example.

The present disclosure relates to an operating method for a conveying device with an eccentric screw pump for conveying viscous construction materials according to the preamble of claim 1.

WO 2019/215242 A1 discloses a method for operating a conveying device for conveying a free-flowing construction material with an eccentric screw pump in which the actual pressure is subjected to closed-loop control. This operating method does not make it possible to distinguish between a pressure buildup against a closed gun and conveyance against an open gun. Consequently, when there is a pressure buildup against the closed gun, a so-called slip effect occurs, having the result that the construction material in the eccentric screw pump is overworked, so that the material properties of the conveyed construction material are changed and the eccentric screw pump undergoes increased wear, heats up undesirably and has unnecessary energy consumption.

An object of the present disclosure is to propose an operating method for a conveying device with an eccentric screw pump for conveying viscous construction materials by which a pressure buildup against the closed gun can be detected and correspondingly a pressure buildup against the closed gun can be largely avoided.

This object is achieved by the features of claim 1. Advantageous and expedient developments are specified in the subclaims.

The operating method according to one example for a conveying device with an eccentric screw pump for conveying viscous construction materials comprises the following steps:

- sensing a pressure of the construction material at an outlet of the eccentric screw pump when the eccentric screw pump is running and automatically switching off the eccentric screw pump if the pressure exceeds an upper limit value;
- sensing a characteristic variable of the running eccentric screw pump and comparison of the characteristic variable with a first comparison variable, which is characteristic of operation with an open dispensing device, and/or with a second comparison variable, which is characteristic of operation with a closed dispensing device, and switching off the eccentric screw pump if operation with a closed dispensing device is detected;
- if continued operation is undertaken, renewed performance of the aforementioned steps takes place;
- if switching off of the eccentric screw pump is undertaken, a pressure prevailing at the outlet of the eccentric screw pump is monitored in such a way that the operation of the eccentric screw pump is started once again and the aforementioned steps are performed once again if
  - either the pressure falls by a first pressure difference within a first time interval due to opening of a dispensing device or an open dispensing device
  - or, for system-related reasons, the pressure falls more slowly to a lower limit value or by a second pressure difference with a closed dispensing device, the second pressure difference being greater than the first pressure difference.

This avoids the construction material being unnecessarily overworked in the eccentric screw pump with a closed gun. Consequently, changing of the material properties of the conveyed construction material that is caused by overworking is avoided and both increased wear and unnecessary energy consumption and also undesired heating up are avoided.

It is also provided that a pulsation pattern occurring in the eccentric screw pump during the conveying operation is continuously sensed as a characteristic variable and is continuously compared with a first pulsation pattern, stored as a first comparison variable, and/or with a second pulsation pattern, stored as a second comparison variable. In the comparison with the stored pulsation patterns, it can be reliably detected whether the eccentric screw pump is building up a pressure against a closed gun or is conveying against an open gun.

It is also provided that a temperature of the eccentric screw pump, and in particular a temperature of a rotor of a rotor-stator unit of the eccentric screw pump, is continuously sensed as a characteristic variable and is continuously compared with the temperature stored as a first comparison variable and/or with the temperature stored as a second comparison variable. As a result, it can be easily detected that the eccentric screw pump is building up pressure against a closed gun and is overworking the construction material, since this is accompanied by the development of heat and consequently also quickly leads to an increasing of a temperature of the eccentric screw and consequently also the rotor of the eccentric screw.

It is also provided that the first and/or second pulsation pattern stored as a comparison variable is created on the basis of pressure values sensed by the pressure sensor and/or is created on the basis of speed values of a BLDC electric motor driving the eccentric screw pump and/or is created on the basis of current intensity values of a BLDC electric motor driving the eccentric screw pump that are typical of an applied torque. In this way, the pulsation pattern can be easily determined with the technology installed in the conveying device.

Finally, it is provided that, after an interim switching off of the eccentric screw pump, a final switching off takes place if the pressure falls by a third pressure difference within a third time interval, the third time interval and the third pressure difference being typical of a rotor-stator unit that is defective due to wear. As a result, it can be easily detected and signaled that the eccentric screw pump has reached a wear limit and should be changed. Consequently, the reaching of the wear limit can also be indicated to the user optically and/or acoustically.

Further details of the present disclosure are described in the drawing on the basis of schematically represented exemplary embodiments.

Switching off of the eccentric pump is understood as meaning in the sense of the present disclosure automatic switching off of the BLDC electric motor which drives the eccentric screw pump with a gear mechanism interposed.

A pressure prevailing at an outlet of the eccentric screw pump is understood as meaning in the sense of the present disclosure a pressure which is sensed in a conveying section following the eccentric screw pump.

A first comparison variable and a second comparison variable are understood in the sense of the present disclosure as respectively also meaning a dataset describing the first or second stored pulsation pattern or a formula describing the first or second stored pulsation pattern. Here, the respective dataset or the respective formula describes a pulsation pattern which is determined on the basis of pressure values sensed by a pressure sensor and/or is determined on the basis of speed values of a BLDC electric motor driving the eccentric screw pump and/or is determined on the basis of current intensity values of a BLDC electric motor driving the eccentric screw pump that are in particular typical of an applied torque.

Similarly, a sensed characteristic variable is understood as also meaning in the sense of the present disclosure a dataset describing a sensed pulsation pattern or a formula describing the sensed pulsation pattern.

In FIG. 1, a conveying device 1 for carrying out the method according to one example is shown in a perspective view.

Figure 2:
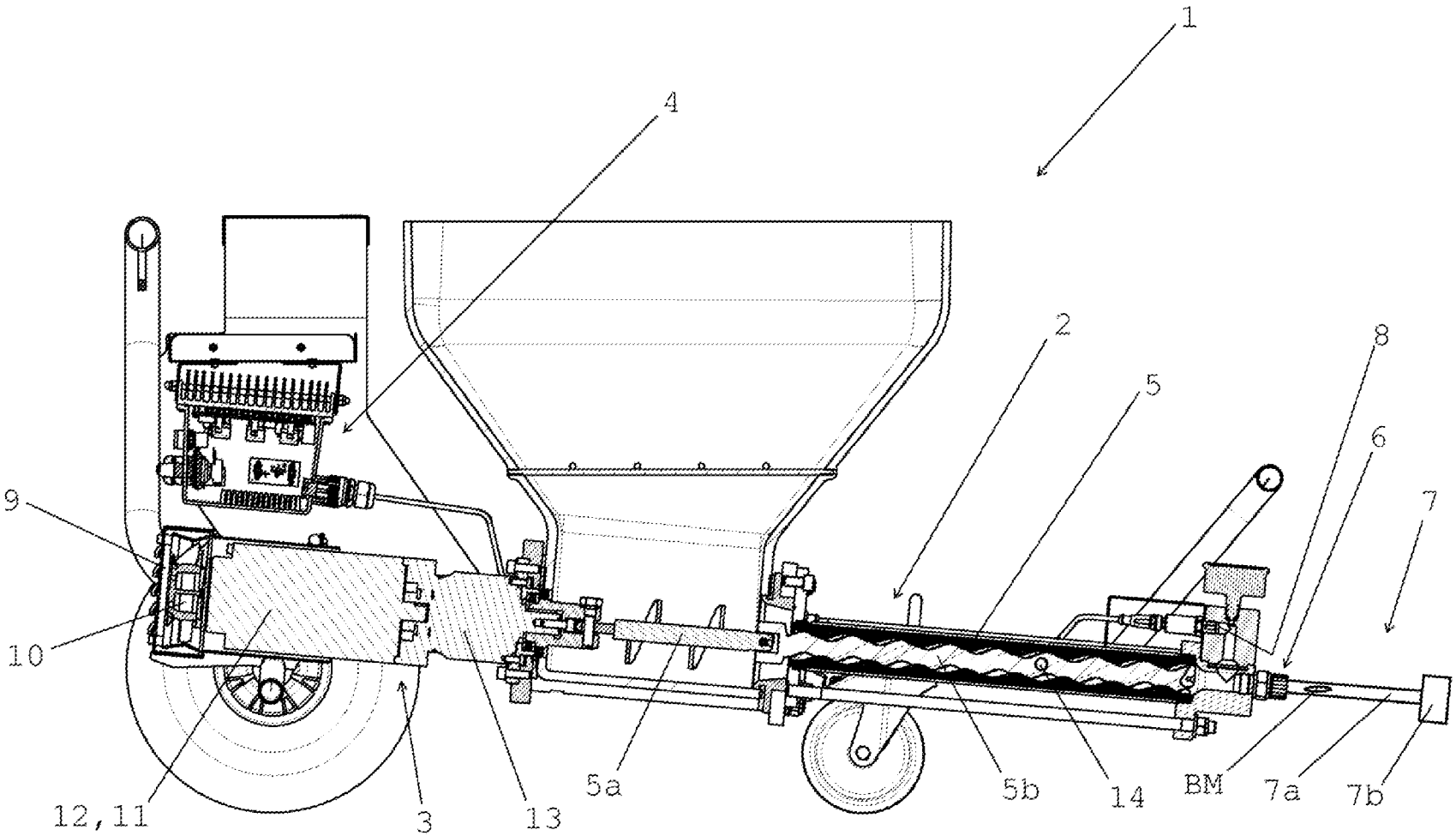
FIG. 2 shows a sectional side view of the conveying device shown in FIG. 1.

In FIG. 2, the conveying device 1 known from FIG. 1 is represented in a partially sectional side view. The conveying device 1 comprises an eccentric screw pump 2, a drive unit 3 and a controller 4. The eccentric screw pump 2 comprises a rotor-stator unit 5 with an upstream conveying screw 5*a* and an outlet 6. The conveying device 1 also comprises a schematically represented conveying section 7, which is connected to the outlet 6 of the rotor-stator unit 5. The conveying section 7 comprises a hose 7*a* and a dispensing device 7*b*, by means of which the discharge of viscous construction material BM can be activated and deactivated and preferably can also be metered.

The conveying device 1 also comprises a first pressure sensor 8 and a characteristic-variable sensing device 9. Here, a pressure under which the construction material BM is at the outlet 6 of the rotor-stator unit 5 is sensed by the pressure sensor 8. The characteristic-variable sensing device 9 comprises a speed sensor 10, by means of which a rotational speed of an electric motor 11 of the drive unit 3 of the conveying device 1 can be sensed. Here, the electric motor 11 is designed as a brushless direct-current motor, a so-called BLDC electric motor 12, and the speed sensor 10 according to one embodiment variant comprises a HALL sensor installed directly on the BLDC electric motor 12. Along with the drive 11, the drive unit 3 also comprises a gear mechanism 13, which is installed between the drive 11 and the eccentric screw pump 2.

A schematically represented temperature sensor 14 is installed on the conveying device. Here, a temperature of a rotor 5*b* of the rotor-stator unit 5 is sensed by the temperature sensor 14.

Figure 3:
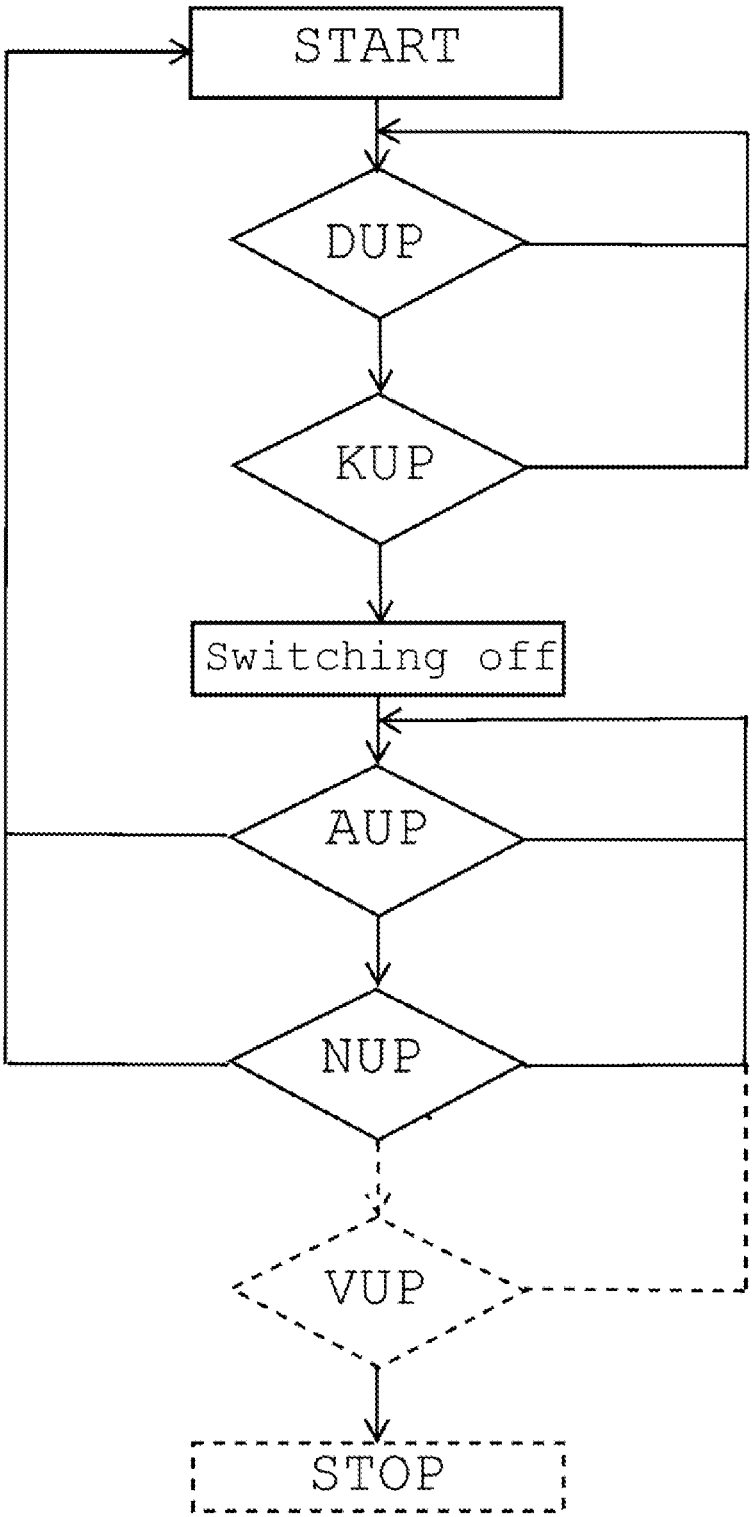
FIG. 3 shows a schematic flow diagram of an operating method, in one example.

In FIG. 3, a simplified flow diagram of an operating method BV is shown.

The operating method BY comprises the following steps:

within a pressure monitoring program DUP, a sensing of a pressure of the viscous construction material takes place at an outlet of the eccentric screw pump with the eccentric screw pump running and automatic switching off of the eccentric screw pump takes place if the pressure exceeds an upper limit value stored in the controller;

within a characteristic-variable monitoring program KUP, a sensing of a characteristic variable of the continuous eccentric screw pump takes place and comparison of the characteristic variable with a first comparison variable, which is stored in the controller and is characteristic of operation with an open dispensing device, takes place and/or comparison of the characteristic variable with a second comparison variable, which is stored in the controller and is characteristic of operation with a closed dispensing device, takes place and switching off of the eccentric screw pump takes place if operation with a closed dispensing device is detected;

if continued operation of the eccentric screw pump is undertaken, renewed performance of the aforementioned steps takes place, and thereby the pressure monitoring program DUP and the characteristic-variable monitoring program KUP;

if switching off of the eccentric screw pump is undertaken as a result of the aforementioned steps, a pressure prevailing at the outlet of the eccentric screw pump is monitored by a dispensing monitoring program AUP and a low-pressure monitoring program NUP in such a way that the operation of the eccentric screw pump is started once again and the aforementioned steps are performed once again if either it is established by the dispensing monitoring program AUP that the pressure falls by a predetermined pressure difference within a first time interval due to opening of a dispensing device or an open dispensing device, with for example a fall of the pressure by 10 bar in 1 to 2 seconds having to be detected or it is established by the low-pressure monitoring program NLP that, for system-related reasons, the pressure falls more slowly to a lower limit value or by a second pressure difference with a closed dispensing device, with the pressure falling for example in 30 minutes by 50 bar below a setpoint value and the second pressure difference being greater than the first pressure difference, the eccentric screw pump otherwise remaining switched off and pressure monitoring being continued.

Optionally, it is provided—as schematically shown in FIG. 3 by dashed lines—that the operating method is supplemented by a wear monitoring program VUP to the extent that, after an interim switching off of the eccentric screw pump 2, a final switching off takes place if the pressure falls by a third pressure difference within a third time interval, the third time interval and the third pressure difference being chosen, dependent on the conveying device 1, such that they are typical of a rotor-stator unit 5 that is defective due to wear.

The conveying device 1 may also be operated such that a pulsation pattern occurring in the eccentric screw pump 2 is continuously sensed by the controller 5 as a characteristic variable and is continuously compared by the controller 5 with a first pulsation pattern, stored in the controller 5 as a first comparison variable, and/or with a second pulsation pattern, stored in the controller as a second comparison variable.

Alternatively, the conveying device may also be operated such that a temperature of the eccentric screw pump 2, and in particular a temperature of a rotor 5*b* of a rotor-stator unit 5 of the eccentric screw pump 2, is continuously sensed by the controller 5 as a characteristic variable and is continuously compared with the temperature stored in the controller 5 as a first comparison variable and/or with the temperature stored in the controller 5 as a second comparison variable.

It is provided that a first and a second pulsation pattern stored as a comparison variable are created on the basis of pressure values sensed by the pressure sensor 8 and/or are created on the basis of speed values of a BLDG electric motor 12 driving the eccentric screw pump 2 and/or are created on the basis of current intensity values of a BLDC electric motor 12 driving the eccentric screw pump 2.

Although the present invention has been described with reference to preferred embodiments, workers skilled in the art will recognize that changes may be made in form and detail without departing from the spirit and scope of the invention.

LIST OF DESIGNATIONS

1 Conveying device
2 Eccentric screw pump
3 Drive unit
4 Controller
5 Rotor-stator unit
5*a* Conveying screw of 5
5*b* Rotor of 5
6 Outlet
7 Conveying section
7*a* Hose of 7
7*b* Dispensing device of 7
8 Pressure sensor
9 Characteristic-variable sensing device
10 Speed sensor
11 Electric motor
12 BLDC electric motor
13 Gear mechanism
14 Temperature sensor
BM Viscous construction material
BV Operating method
DUP Pressure monitoring program
KUP Characteristic-variable monitoring program
AUP Dispensing monitoring program
NUP Low-pressure monitoring program
VUP Wear monitoring program

The invention claimed is:

1. An operating method (BV) for a conveying device with an eccentric screw pump for conveying viscous construction materials (BM) comprising the following steps:

sensing a pressure of the construction materials (BM) at an outlet of the eccentric screw pump when the eccentric screw pump is running and automatically switching off the eccentric screw pump if the pressure exceeds an upper limit value, otherwise continued operation of the eccentric screw pump;

sensing a characteristic variable of the running eccentric screw pump and comparison of the characteristic variable with a first comparison variable, which is characteristic of operation with an open dispensing device, and/or with a second comparison variable, which is characteristic of operation with a closed dispensing device, and switching off the eccentric screw pump if operation with a closed dispensing device is detected, otherwise continued operation of the eccentric screw pump;

if continued operation is undertaken, renewed performance of the aforementioned steps takes place;

if switching off of the eccentric screw pump is undertaken, a pressure prevailing at the outlet of the eccentric screw pump is monitored in such a way that the operation of the eccentric screw pump is started once again and the aforementioned steps are performed once again if either the pressure prevailing at the outlet of the eccentric screw pump falls by a first pressure difference within a first time interval due to opening of a dispensing device or an open dispensing device or, for system-related reasons, the pressure prevailing at the outlet of the eccentric screw pump falls more slowly to a lower limit value or by a second pressure difference with a closed dispensing device, the second pressure difference being greater than the first pressure difference.

2. The operating method as claimed in claim 1, wherein a pulsation pattern occurring in the eccentric screw pump during a conveying operation is continuously sensed as a characteristic variable and is continuously compared with at least one of:

a first pulsation pattern, stored as a first comparison variable, or a second pulsation pattern, stored as a second comparison variable.

3. The operating method as claimed in claim 1, wherein a temperature of the eccentric screw pump is continuously sensed as a characteristic variable and is continuously compared with at least one of:

a temperature stored as a first comparison variable, or a temperature stored as a second comparison variable.

4. The operating method as claimed in claim 2, wherein the at least one of a first second pulsation or a second pulsation pattern is created on the basis of pressure values sensed by a pressure sensor and/or is created on the basis of speed values of a BLDC electric motor driving the eccentric screw pump and/or is created on the basis of current intensity values of a BLDC electric motor driving the eccentric screw pump.

5. The operating method as claimed in claim 1, wherein, after an interim switching off of the eccentric screw pump, a final switching off takes place if the pressure falls by a third pressure difference within a third time interval, the third time interval and the third pressure difference representing a rotor-stator unit that is defective due to wear.

6. The operating method as claimed in claim 3, wherein the temperature of the eccentric screw pump comprises a temperature of a rotor of a rotor-stator unit of the eccentric screw pump.

7. A method of operating a conveying device with an eccentric screw pump for conveying a construction material, the method comprising:

sensing a pressure of the construction material at an outlet of the eccentric screw pump when the eccentric screw pump is running to provide the construction material to a dispensing device;

based on the pressure exceeding an upper limit value, automatically switching off the eccentric screw pump;

sensing a characteristic variable of the eccentric screw pump;

comparing the characteristic variable with at least one of:

a first comparison variable that represents operation of the dispensing device in an open position, or a second comparison variable that represents operation of the dispensing device in a closed position:

switching off the eccentric screw pump based on detecting operation of the dispensing device in the closed position;

based on the switching off of the eccentric screw pump, monitoring a pressure prevailing at the outlet of the eccentric screw pump and restarting the operation of the eccentric screw pump in response to detecting at least one of:

the pressure prevailing at the outlet of the eccentric screw pump falling by a first pressure difference within a first time interval due to opening of the dispensing device or the dispensing device being in the open position, or the pressure prevailing at the outlet of the eccentric screw pump falling to a lower limit value or by a second pressure difference with the dispensing device in the closed position, the second pressure difference being greater than the first pressure difference.

8. The method of claim 7, wherein a pulsation pattern occurring in the eccentric screw pump during a conveying operation is continuously sensed as a characteristic variable and is continuously compared with at least one of:

a first pulsation pattern, stored as a first comparison variable, or a second pulsation pattern, stored as a second comparison variable.

9. The method of claim 7, and further comprising comparing a sensed pulsation pattern occurring in the eccentric screw pump during a conveying operation with a stored pulsation pattern that is based on at least one of:

a pressure value sensed by a pressure sensor, a speed value of a BLDC electric motor driving the eccentric screw pump, or a current intensity value of a BLDC electric motor driving the eccentric screw pump.

10. The method of claim 8, and further comprising sensing a temperature of a rotor of a rotor-stator unit of the eccentric screw pump.

11. The method of claim 7, and further comprising:

after an interim switching off of the eccentric screw pump, performing a final switching off of the eccentric screw pump based on the pressure falling by a third pressure difference within a third time interval, the third time interval and the third pressure difference representing a rotor-stator unit that is defective due to wear.

12. The method of claim 7, wherein a temperature of the eccentric screw pump is continuously sensed as a characteristic variable and is continuously compared with at least one of:

a temperature stored as a first comparison variable, or a temperature stored as a second comparison variable.

13. A conveying device comprising:

an eccentric screw pump; and a controller configured to:

receive a pressure of a construction material at an outlet of the eccentric screw pump when the eccentric screw pump is running to provide the construction material to a dispensing device;

based on the pressure exceeding an upper limit value, automatically switch off the eccentric screw pump;

detect a characteristic variable of the eccentric screw pump;

compare the characteristic variable with at least one of:

a first comparison variable that represents operation of the dispensing device in an open position, or a second comparison variable that represents operation of the dispensing device in a closed position:

switch off the eccentric screw pump based on detecting operation of the dispensing device in the closed position;

based on the switch off of the eccentric screw pump, monitoring a pressure prevailing at the outlet of the eccentric screw pump and restarting the operation of the eccentric screw pump in response to detecting at least one of:

the pressure prevailing at the outlet of the eccentric screw pump falling by a first pressure difference within a first time interval due to opening of the dispensing device or the dispensing device being in the open position, or the pressure prevailing at the outlet of the eccentric screw pump falling to a lower limit value or by a second pressure difference with the dispensing device in the closed position, the second pressure difference being greater than the first pressure difference.

14. The conveying device of claim 13, wherein a pulsation pattern occurring in the eccentric screw pump during a conveying operation is continuously sensed as a characteristic variable and is continuously compared with at least one of:

a first pulsation pattern, stored as a first comparison variable, or a second pulsation pattern, stored as a second comparison variable.

15. The conveying device of claim 14, wherein the controller is configured to compare a sensed pulsation pattern occurring in the eccentric screw pump during the conveying operation with a stored pulsation pattern that is based on at least one of:

a pressure value sensed by a pressure sensor, a speed value of a BLDC electric motor driving the eccentric screw pump, or a current intensity value of a BLDC electric motor driving the eccentric screw.

16. The conveying device of claim 14, wherein a temperature of the eccentric screw pump is continuously sensed as a characteristic variable, wherein the temperature of the eccentric screw pump comprises a temperature of a rotor of a rotor-stator unit of the eccentric screw pump.

17. The conveying device of claim 13, wherein the controller is configured to:

after an interim switching off of the eccentric screw pump, perform a final switching off of the eccentric screw pump based on the pressure falling by a third pressure difference within a third time interval, the third time interval and the third pressure difference representing a rotor-stator unit that is defective due to wear.

18. The conveying device of claim 13, wherein a temperature of the eccentric screw pump is continuously sensed as a characteristic variable and is continuously compared with at least one of:

a temperature stored as a first comparison variable, or a temperature stored as a second comparison variable.

* * * * *